United States Patent [19]

Löfgren et al.

[11] Patent Number: 4,993,841

[45] Date of Patent: Feb. 19, 1991

[54] MAGNETIC IMPELLER MEANS FOR A MIXING VESSEL

[75] Inventors: Peter Löfgren, Hovås; Nils Arthun, Partille, both of Sweden

[73] Assignee: Steridose Systems AB, Askim, Sweden

[21] Appl. No.: 11,321

[22] Filed: Feb. 5, 1987

[51] Int. Cl.[5] ..... B01F 13/08

[52] U.S. Cl. ..... 366/274; 366/314; 366/331; 415/116; 415/121.1

[58] Field of Search ..... 366/331, 273, 274, 138, 366/279, 314, 169; 415/121 R, 116

[56] References Cited

U.S. PATENT DOCUMENTS

| | | | |
|---|---|---|---|
| 2,495,895 | 1/1950 | Hervert | 366/273 |
| 3,062,512 | 11/1962 | Carter | 366/138 X |
| 3,433,465 | 3/1969 | Szpur | 366/274 X |
| 3,580,547 | 5/1971 | Amorese | 366/138 |
| 3,694,341 | 9/1972 | Luck | 366/273 X |
| 3,730,488 | 5/1973 | Gardner | 366/273 X |
| 4,194,843 | 3/1980 | Martin | 366/138 |
| 4,663,055 | 5/1987 | Ling | 366/169 X |

*Primary Examiner*—Frankie L. Stinson

*Attorney, Agent, or Firm*—Wegner, Cantor, Mueller & Player

[57] ABSTRACT

Mixing vessel for sterile fluids, having a closed recess forming an integral part of the bottom wall of said vessel. An externally mounted rotatable drive unit on said vessel has means for establishing a magnetic coupling with an impeller inside the vessel. The hub of said impeller is cup-shaped and supported on bearing means on the inner end of the recess with a certain radial play to the wall of said recess, coaxially with said coupling means, and has substantially radially extending passageways between inner and outer hub surfaces.

5 Claims, 2 Drawing Sheets

FIG. 1
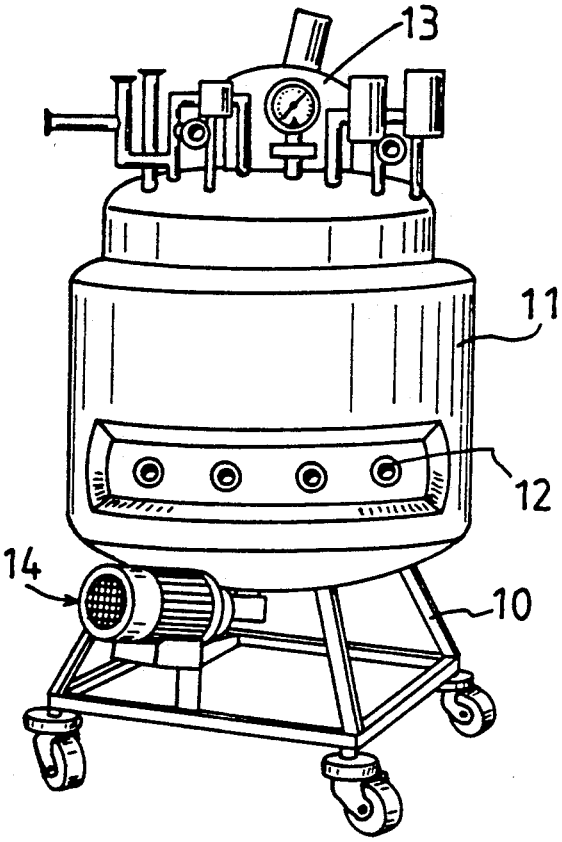
FIG. 3
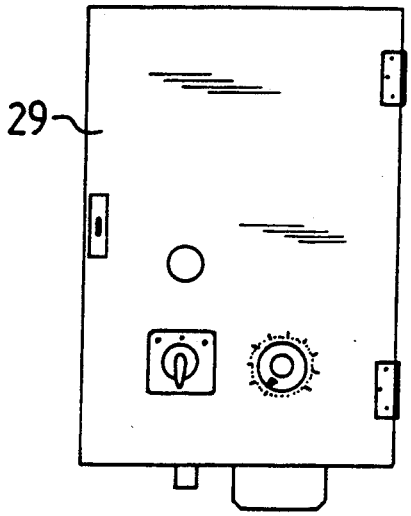
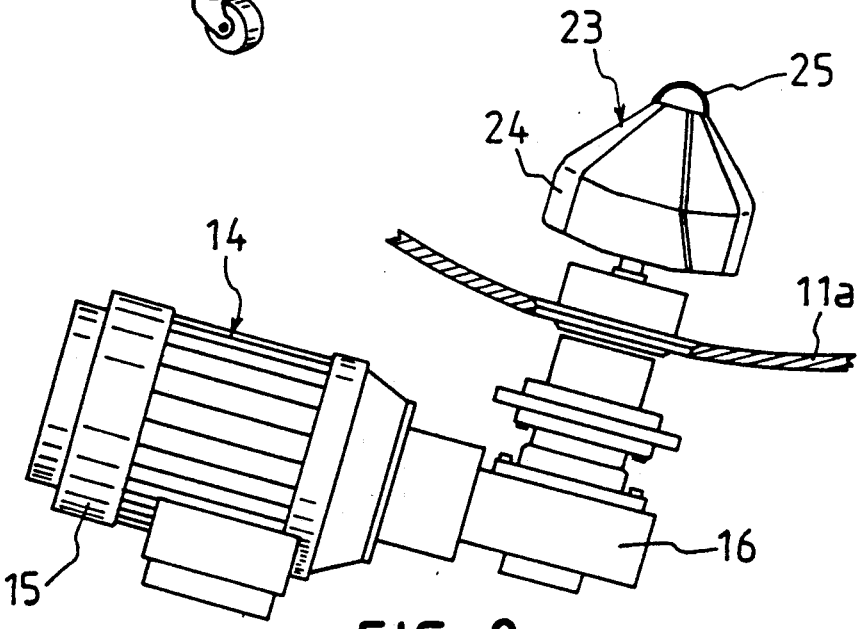
FIG. 2

MAGNETIC IMPELLER MEANS FOR A MIXING VESSEL

BACKGROUND OF THE INVENTION

1. Field of the Invention

This invention relates to a mixing vessel for sterile fluids, having a closed recess forming an integral part of the bottom wall of said vessel, and comprising a rotatable drive unit mounted externally of said vessel and having magnetic means for establishing a magnetic force coupling with an impeller inside said vessel, said magnetic means reaching into said recess, and bearing means supporting the hub of said impeller in a rotatable manner through the action of said external drive unit.

2. Description of the prior art

It is known to generate a stirring motion within a sealed vessel by means of a magnetic coupling between an external drive unit and a completely separate internal impeller. Mixing vessels of this kind have hitherto during cleaning required removal of the impeller and are therefore not suitable for in-line sterilization with overheated steam.

SUMMARY OF THE INVENTION

The primary object of the invention is to provide mixing vessels of the type described above, enabling sterilization with the impeller in place. The hub of the impeller according to the invention is cup-shaped and supported within the vessel on bearing means at the inner end of the recess, with a certain radial play to the recess wall, and has substantially radially extending borings, forming passageways between inner and outer hub surfaces.

Additional features of preferred embodiments of the mixing vessel according to the invention will be seen from the following description and from an embodiment illustrated in the accompanying drawings.

BRIEF DESCRIPTION OF THE DRAWINGS

FIG. 1 shows a mixing vessel according to the invention in a perspective view, FIG. 2 is a perspective view in an enlarged scale showing the mixing apparatus of the vessel in FIG. 1, FIG. 3 is a plan view of a control unit of the mixing apparatus.

DESCRIPTION OF THE PREFERRED EMBODIMENT

Figure 4:
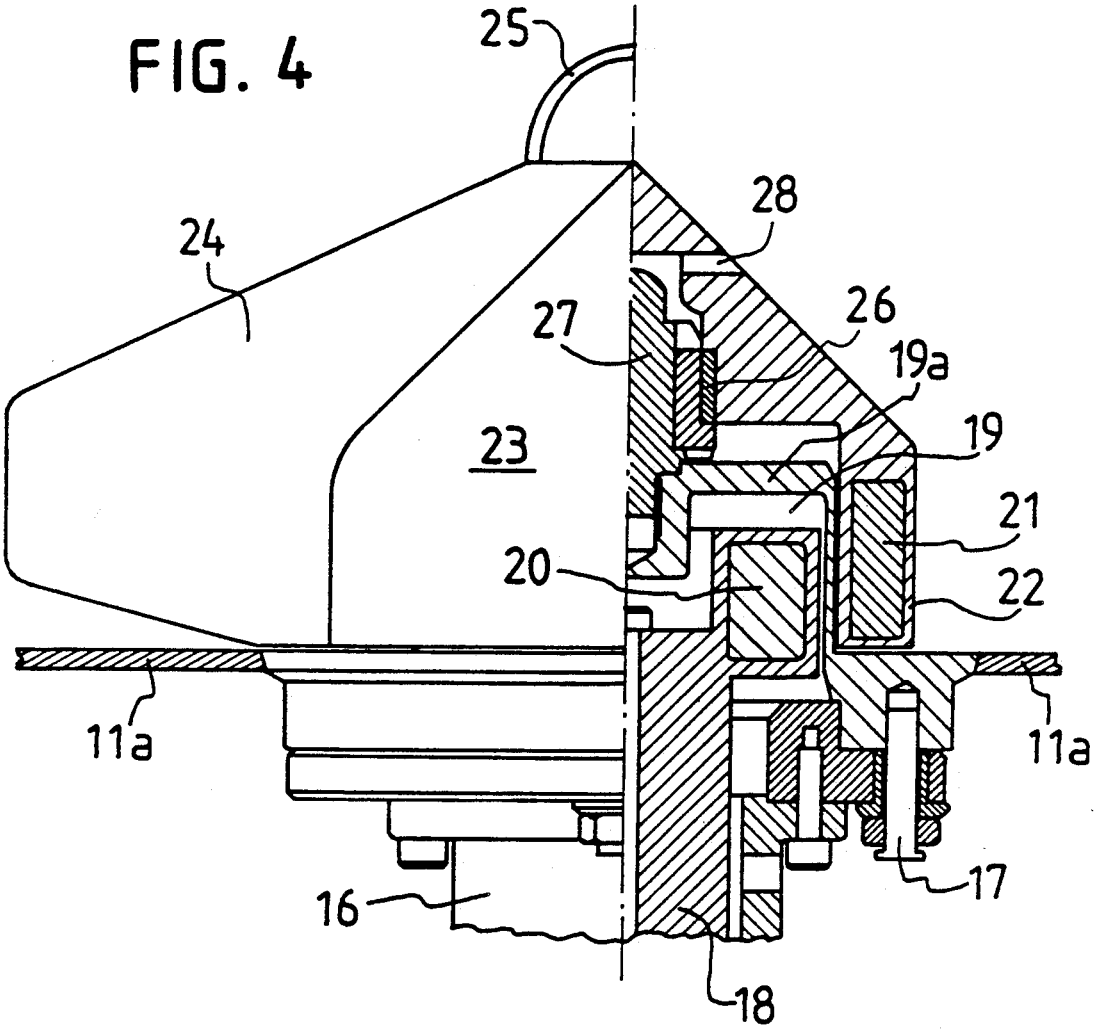
FIG. 4 is a partly sectioned side view of the impeller in the vessel according to the invention including support means.
Figure 5:
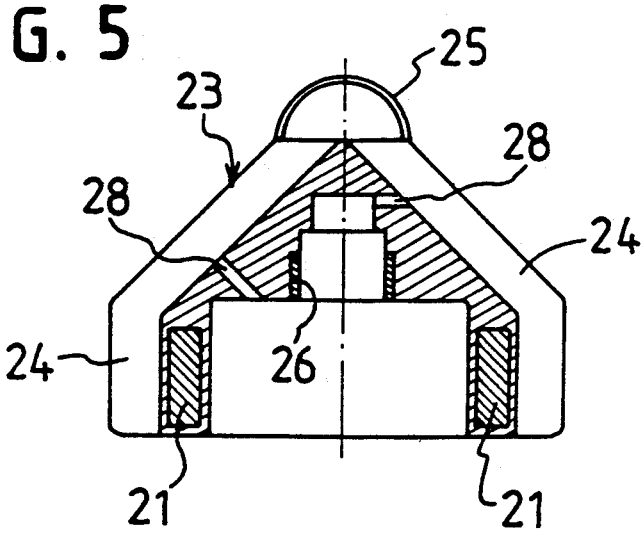
FIG. 5 shows the same impeller in smaller scale without said support means.

The mixing vessel illustrated in FIG. 1 comprises a four wheeled chassis 10, which carries the vessel proper 11. The vessel is intended for use in a large process plant and has a number of inlets and outlets 12 and regulating means 13. Different sterile fluids are delivered to the vessel, where they are mixed together by means of a mixing apparatus 14 and the resulting mixture is drained from the vessel.

The mixing apparatus 14 is better shown in FIG. 2 and comprises an electric or fluid driven motor 15 which is attached to a gear box unit 16. The gear box reduces the motor speed and alters its rotation axis 90°. The gear box unit 16 is fitted to the bottom of the vessel 11 by means of a bayonet connection system having two peripherical slots cooperating with two lock bolts 17 (see FIG. 4), allowing a flange 16*a* on the gear box unit 16 to be slipped over said bolts, turned together with the motor 15 to a locking position and then tightened in place by means of said two locking bolts 17. This connection system allows easy connection and dismantling of the motor together with gear box unit from the vessel.

The output shaft 18 of the gear box unit 16 reaches into a cylindrical recess 19 in the vessel wall 11*a*. The end of said shaft 18 has at least three circumferentially spaced permanent magnets 20.

The same number of permanent magnets 21 are arranged and hermetically sealed in the hub 22 of an impeller 23. The impeller has four angled vaneblades 24 and one central lifting ring 25.

The interior of the hub 22 is hollow with one inner small diameter and another outer larger diameter, wherein said outer diameter encompasses the cylindrical recess 19. The inner small diameter has a sleeve-formed bearing 26 which cooperates with a short bearing shaft 27 mounted on the circular end 19*a* of said cylindrical recess 19, forming a pivot point for the impeller 23 coaxially with the output shaft 18 to the motor 15. Said pivot point maintains a certain radial play between the hub and the recess wall.

Thus, when the output shaft 18 rotates the magnetic coupling between said shaft and the impeller 23 transmit the rotation of the impeller, without any physical contact.

The hub of the impeller has substantially radially extending borings 28 forming passageways between inner and outer surfaces on said impeller. These borings 28 will, during the rotation of the impeller, draw fluid from the inner of the impeller via the radial play to the recess wall and allow a continuous liquid flow to the outside, through the action of the centrifugal force. This will prevent solid matter in the fluids from accumulating within the hub 22. It also means that a rinsing fluid can pass freely through the impeller and the borings 28 will allow steam to enter and condensate on all surfaces, whereafter it can be drained, so that safe steam sterilization conditions are obtained. Thus, the mixing vessel according to the invention can be cleaned and sterilized without removal of the impeller, so that time consuming dismantling and connection work can be avoided.

In FIG. 3 is shown a control box unit 29 which enables the rotational speed of impeller to be variated steplessly from 0–500 rpm (circa).

It should be apparent that several modifications are possible within the scope of the appending claims.

We claim:

1. A mixing vessel for sterile fluids, having a closed recess forming an integral part of the bottom wall of said vessel by having a recess wall projecting internally from said bottom wall and terminating at an inner end, comprising: a rotatable drive unit mounted externally of said vessel and having magnetic means for establishing a magnetic force coupling with an impeller having a hub with inner and outer surfaces inside said vessel, said magnetic means reaching into said recess, and bearing means at the inner end of said recess supporting the hub of said impeller with a certain radial play to the wall of said recess coaxially with said magnetic coupling means in a rotatable manner through the action of said magnetic coupling, said hub being cup-shaped and having substantially radially extending borings forming passageways between inner and outer hub surfaces.

2. A mixing vessel according to claim 1, wherein the hub has internally mounted and hermetically sealed magnetic means for cooperation with the magnetic means on said drive unit.

3. A mixing vessel according to claim 2, wherein the drive unit is mounted on the vessel via a bayonet connection system.

4. A mixing vessel according to claim 1, wherein the drive unit is mounted on the vessel via a bayonet connection system.

5. A mixing vessel according to claim 1, wherein the rotation speed of the drive unit is adjustable via control means, in order to provide a continuous flow of rinsing fluid between the hub and the recess wall and through said hub passageways.

* * * * *